United States Patent [19]

Machin et al.

[11] Patent Number: 5,006,273

[45] Date of Patent: Apr. 9, 1991

[54] CONCENTRATED AQUEOUS LIQUID DETERGENTS CONTAINING VISCOSITY REDUCING POLYMERS

[75] Inventors: David Machin, Merseyside, England; Johannes C. van de Pas, Vlaardingen, Netherlands

[73] Assignee: Lever Brothers Company, Division of CONOPCO, Inc., New York, N.Y.

[21] Appl. No.: 224,518

[22] Filed: Jul. 26, 1988

[30] Foreign Application Priority Data

Jul. 31, 1987 [GB] United Kingdom ..... 8718217

[51] Int. Cl.[5] ..... C11D 337; C11D 1/83; C11D 3/395

[52] U.S. Cl. ..... 252/174.23; 252/95; 252/173; 252/174.24; 252/DIG. 2; 252/DIG. 14

[58] Field of Search ..... ..... 252/174.23, 174.24, 252/DIG. 2, DIG. 14, 173

[56] References Cited

U.S. PATENT DOCUMENTS

| | | | |
|---|---|---|---|
| 4,244,840 | 1/1981 | Straw | 252/540 |
| 4,384,978 | 5/1983 | Ploog et al. | 252/353 |
| 4,452,717 | 6/1984 | Tai et al. | 252/109 |
| 4,476,037 | 10/1984 | Ploog et al. | 252/354 |
| 4,482,470 | 11/1984 | Reuter et al. | 252/162 |
| 4,530,780 | 7/1985 | van de Pas et al. | 252/528 |
| 4,597,889 | 7/1986 | Jones et al. | 252/135 |
| 4,614,606 | 9/1986 | Machin et al. | 252/116 |
| 4,642,198 | 2/1987 | Humphreys et al. | 252/94 |

FOREIGN PATENT DOCUMENTS

| | | |
|---|---|---|
| 2138037 | 10/1984 | United Kingdom . |
| 2168717 | 6/1986 | United Kingdom . |

*Primary Examiner*—Paul Lieberman
*Assistant Examiner*—A. Beadles-Hay
*Attorney, Agent, or Firm*—Ronald A. Koatz

[57] ABSTRACT

The viscosity of concentrated liquid detergents with high concentrations of surfactant and no more than 5% by weight of swelling clay, may be reduced if the concentrate comprises less than 15% by volume of suspended solid material and is formulated thus:

(a) at least 15% by weight of detergent active material;

(b) from 1 to 30% by weight of a salting-out electrolyte;

(c) from 0.1 to 20% by weight of a viscosity reducing water soluble polymer in an amount sufficient to reduce the viscosity by more than 5% when measured at a shear rate of 21 $S^{-1}$ and in comparison with a composition identical except that all such polymer is omitted, said polymer having an electrolyte resistance of more than 5 grams sodium nitrilotriacetate in 100 ml of a 5% by weight aqueous solution thereof, with the system adjusted to neutral pH, and said polymer having a vapor pressure in 20% aqueous solution equal to or less than the vapor pressure of a reference 2% by weight or greater aqueous solution of polyethylene glycol having an average molecular weight of 6000;

said viscosity reducing polymer having molecular weight of at least 1000.

14 Claims, No Drawings

CONCENTRATED AQUEOUS LIQUID DETERGENTS CONTAINING VISCOSITY REDUCING POLYMERS

The present invention is concerned with liquid detergent compositions of the kind in which particles of solid material can be suspended by a structure formed from detergent active material, the active structure existing as a separate phase dispersed within predominantly aqueous phase. This aqueous phase contains dissolved electrolyte Three common product forms of this type are liquids for heavy duty fabrics washing and liquid abrasive and general purpose cleaners. In the first class, the suspended solid can be substantially the same as the dissolved electrolyte, being an excess of same beyond the solubility limit. This solid is usually present as a detergency builder, i.e. to counteract the effects of calcium ion water hardness in the wash. In addition, it may be desirable to suspend substantially insoluble particles of bleach, for example diperoxydodecandioic acid (DPDA). In the second class, the suspended solid is usually a particulate abrasive, insoluble in the system. In that case the electrolyte is a different, water soluble material, present to contribute to structuring of the active material in the dispersed phase. In certain cases, the abrasive can however comprise partially soluble salts which dissolve when the product is diluted. In the third class, the structure is usually used for thickening products to give consumer-preferred flow properties, and sometimes to suspend pigment particles. Compositions of the first kind are described, for example, in our patent specification EP-A-38,101 whilst examples of those in the second category are described in our specification EP-A-140,452. Those in the third category are, for example, in U.S. Pat. No. 4,244,840.

The dispersed structuring phase in these liquids is generally believed to consist of an onion-like configuration comprising concentric bilayers of detergent active molecules, between which is trapped water (aqueous phase). These configurations of active material are sometimes referred to as lamellar droplets. It is believed that the close-packing of these droplets enables the solid materials to be kept in suspension. The lamellar droplets are themselves a sub-set of lamellar structures which are capable of being formed in detergent active/aqueous electrolyte systems. Lamellar systems in general, are a category of structures which can exist in detergent liquids. The degree of ordering of these structures, from simple spherical micelles, through disc and rod-shaped micelles to lamellar droplets and beyond progresses with increasing concentrations of the actives and electrolyte, as is well known, for example from the reference H A Barnes, 'Detergents' Ch. 2 in K Walters (Ed.), 'Rheometry:Industrial Applications', J Wiley & Sons, Letchworth 1980. The present invention is concerned with all such structured systems which are capable of suspending particulate solids, but especially those of the lamellar droplet kind.

Two problems are commonly encountered when formulating liquids with solids suspended by these systems, especially lamellar droplets The first is high viscosity, rendering the products difficult to pour and the second is instability, i.e. a tendency for the dispersed and aqueous phases to separate upon storage at elevated, or even ambient temperatures Thus care must always be exercised when formulating such liquids so that the nature and concentration of the actives and electrolyte are selected to give the required rheological properties.

However, these formulation techniques are always an exercise in balancing the intended rheology with the ideal ingredients in the formulation and some combinations will not be practicable. One example is when one wishes to make a concentrated product in which the total amount of detergent actives is relatively high in proportion to the other components. The main problem which usually manifests itself here is an unacceptably high viscosity. The maximum viscosity tolerable in fabric washing compositions according to this invention is 1000 mPaS, determined as a practical upper limit of pourability. For general purpose cleaners, here 850 mPaS is preferred as an upper limit, especially a viscosity in the range of from 500 to 700 mPaS, being levels corresponding to acceptable surface spreading properties. All these values are as obtained at a shear rate of $21S^{-1}$.

One approach to viscosity control in general is to formulate the liquids to be shear-thinning, i.e. accepting the high viscosity of the product at rest in a bottle but devising the composition such that the action of pouring causes shear beyond the yield point, so that the product then flows more easily. This property is utilised in the compositions described in our aforementioned specification EP-A-38,101. Unfortunately, it has been found that this cannot easily be utilised in liquids with high levels of active.

Polymers have been used for viscosity control in slurries intended for spray-drying, for example as described in specification EP-A-24,711. However, such slurries have no requirement of stability and so there is no difficulty with how the polymer should be incorporated.

It is also known that incorporation of 5% or more of fabric softening clays, (e.g. bentonites) in liquids can give rise to unacceptably high viscosity. One approach to mitigate this disadvantage has been to also incorporate a small amount of a low molecular weight polyacrylate. This is described in UK patent specification GB-A-2,168,717.

We have found that these polymers are really unable to give adequate viscosity control in structured liquids with high active levels and 5% by weight or more of swelling clays. However, we have now been surprised to discover that if the components are chosen according to a certain rule (defined hereinbelow), it is possible to formulate active-concentrated liquids which have both acceptable viscosity (pourability) and stability.

Thus according to the present invention, we provide an aqueous, surfactant-structured liquid detergent concentrate comprising less than 15% by volume of suspended solid material and further comprising:

(a) at least 15% by weight of detergent active material;

(b) from 1 to 30% by weight of a salting-out electrolyte;

(c) from 0.1 to 20% by weight of a viscosity reducing water soluble polymer in amount sufficient to reduce the viscosity of the composition by more than 5% when measured at a shear rate of 21 $S^{-1}$ and in comparison with a composition identical except that all such polymer is omitted, said polymer having an electrolyte resistance of more than 5 grams sodium nitrilotriacetate in 100 ml of a 5% by weight aqueous solution thereof, and said polymer having a vapour pressure in 20% aqueous solution equal to or less than the vapour pressure of a reference 2% by weight or greater aqueous solution of polyethylene glycol having an average molecular weight of 6000;

said viscosity reducing polymer having a molecular weight of at least 1000;

and the composition comprising no, or less than 5% by weight of, a swelling clay and yielding no more than 2% phase separation upon storage at 25° C. for 21 days, and having a viscosity of no greater than 1000 mPaS at a shear rate of 21 $S^{-1}$.

We prefer that the viscosity reducing polymer is incorporated at from 0.1 to 2.5% by weight, especially from 0.5 to 1.5% by weight. In many compositions (but not all) levels above these can cause instability. A large number of different polymers may be used, provided the electrolyte resistance and vapour pressure requirements are met. The former is measured as the amount of sodium nitrilotriacetate (NaNTA) solution necessary to reach the cloud point of 100ml of a 5% solution of the polymer in water at 25° C., with the system adjusted to neutral pH, i.e. about 7. This is preferably effected using sodium hydroxide. Most preferably the electrolyte resistance is 10 g NaNTA, especially 15 g. The latter indicates a vapour pressure low enough to have sufficient water binding capability, as generally explained in the applicants' specification GB-A-2,053,249. Preferably the measurement is effected with a reference solution at 10% by weight aqueous concentration, especially 18%.

Typical classes of polymers which may be used provided they meet the above requirement include polyethylene glycols, Dextran, Dextran sulphonates, polyacrylates and polyacrylate/maleic acid co-polymers.

The polymer must have an average molecular weight of at least 1000 but a minimum average molecular weight of 2000 is preferred.

The detergent active material most preferably constitutes at least 20% by weight of the total composition, especially at least 25%, and in any event may be selected from one or more of anionic, cationic, nonionic, zwitterionic and amphoteric surfactants, provided the material forms a structuring system in the liquid. Most preferably, the detergent active material comprises (a) a nonionic surfactant and/or a polyalkoxylated anionic surfactant; and (b) a non-polyalkoxylated anionic surfactant.

Suitable nonionic surfactants which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The anionic detergent surfactants are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularl $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Although we prefer that no fabric softening, swelling clay be present, if included at up to less than 5% by weight, the clay containing material may be any such material capable of providing a fabric softening benefit. Usually these materials will be of natural origin containing a three-layer swellable smectite clay which is ideally of the calcium and/or sodium montmorillonite type. It is preferable to exchange the natural calcium clays to the sodium form by using sodium carbonate, either before or during granulation, as described in GB 2 138 037 (Colgate). The effectiveness of a clay containing material as a fabric softener will depend inter alia on the level of smectite clay. Impurities such as calcite, feldspar and silica will often be present Relatively impure clays can be used provided that such impurities are tolerable in the composition.

In general, the detergent active material may be selected from anionic, cationic, nonionic, zwitterionic and amphoteric surfactants and mixtures thereof.

The compositions also contain a salting-out electrolyte. This has the meaning ascribed to it in specification EP-A-79,646. Optionally, some salting-in electrolyte (as defined in the latter specification) may also be included, provided if of a kind and in an amount compatible with the other components and the composition is still in accordance with the definition of the invention claimed herein. Some or all of the electrolyte (whether salting-in or salting-out ) may have detergency builder properties. In any event, it is preferred that compositions according to the present invention include detergency builder material, some or all of which may be electrolyte. The builder material is any capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorus-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic detergency builders, when present, include water-soluble alkali metal carbonates, bicarbonates, silicates and crystalline and amorphous alumino silicates. Specific examples include sodium carbonate (with or without calcite seeds), potassium carbonate, sodium and potassium bicarbonates, silicates and zeolites.

Examples of organic detergency builders, when present, include the alkaline metal, ammonium and substituted ammonium polyacetates, carboxylates, polycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid.

Apart from the ingredients already mentioned, a number of optional ingredients may also be present, for example lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as tricloroisocyanuric acid, inorganic salts such as sodium sulphate, and, usually present in very minor amounts, fluorescent agents, perfumes, enzymes such as proteases and amylases, germicides and colourants.

The invention will now be illustrated by the following non-limiting examples.

Tables I and II describe base compositions suitable for formulating full fabric washing compositions, such as detailed in Tables 1*a*–6. Table 7 gives formulations of typical general purpose cleaners according to the present invention.

In Tables I, II and 1*a*–6, the following definitions apply:

Actives

Na LAS—Na Dodecyl benzene sulphonate
LES—Lauryl Ether Sulphate (Approx. 3EO)
Synperonic A—Ethoxylated fatty alcohol ($C_{13-15}EO_3$)
Synperonic A7—Ethoxylated fatty alcohol ($C_{13-15}EO_7$)
Synperonic A11—Ethoxylated fatty alcohol ($C_{13-15}EO_{11}$)
Dobanol 23-6.5—Ethoxylated fatty alcohol ($C_{12-13}EO_{6.5}$)

"Electrolytes" 'Citrate' - Sodium citrate

Polymers

PEG—Polyethyleneglycol
Dextran—Polysugar
Dextran Sulphonate—Polysugar Sulphonate
Polyacrylate—Polyacrylate, Sodium Salt
DKW 125—Polyacrylicphosphinate, sodium salt, ex National Starch
Sokalan CP5—Copolymer of acrylate and maleate, sodium salt, ex. BASF
QR 1010—Acrylate copolymer, detailed structure kept secret by supplier, ex Rohm and Haas.

TABLE I

Base Compositions without Minors

| Component | Composition (% w/w) | | | | | | | | |
|---|---|---|---|---|---|---|---|---|---|
| | A | B | C | D | E | F | G | H | K |
| Na LAS | 10.4 | 14.5 | 17.7 | 16.7 | 5.9 | 12.2 | 11.7 | 16.0 | 12.8 |
| LES | — | — | — | — | — | — | — | — | — |
| Synperonic A3 | — | — | — | — | — | — | — | — | — |
| Synperonic A7 | 6.7 | 9.3 | 11.4 | 6.2 | 16.4 | 12.2 | 11.7 | 6.0 | 8.2 |
| Synperonic A11 | — | — | — | — | — | — | — | — | — |
| Na-Citrate | — | — | — | — | — | — | — | — | — |
| NaCl | 4.6 | 4.2 | 3.9 | 4.3 | 8.1 | 4.2 | 8.0 | 8.2 | 15.0 |
| | Composition (% w/w) | | | | | | | | |
| | L | M | N | P | R | S | T | V | X |
| Na LAS | 10.0 | 9.8 | 16.4 | 16.4 | 16.4 | 16.4 | 14.1 | 14.1 | 14.1 |
| LES | — | — | — | 2.2 | 4.4 | 6.6 | 8.8 | 6.6 | 8.8 |
| Synperonic A3 | 5.9 | — | — | — | — | — | — | — | — |
| Synperonic A7 | — | — | 6.6 | 4.4 | 2.2 | — | — | 2.2 | — |
| Synperonic A11 | — | 8.3 | — | — | — | — | — | — | — |
| Na-Citrate | — | — | 10 | 10 | 10 | 10 | 10 | 15 | 15 |
| NaCl | 4.7 | 8.6 | — | — | — | — | — | — | — |
| | All Compositions | | | | | | | | |
| Water | to 100% | | | | | | | | |
| Polymer | when included, additional to above amounts | | | | | | | | |

TABLE II

Base Compositions with Minors

| Component | Composition (% w/w) | | | |
|---|---|---|---|---|
| | AA | BB | CC | DD |
| Na LAS | 16.4 | 14.1 | 15.2 | 15.2 |
| LES | — | 2.2 | 2.2 | 2.2 |
| Dobanol 23-6.5 | 6.6 | 6.6 | 5.5 | 5.5 |
| Na-Citrate | 9.0 | 10.0 | 10.0 | 11.0 |
| Monoethanolamine | 2.0 | | | |
| Fluorescer | 0.1 | | | |
| Na stearate | 0.08 | | | |
| Perfume | 0.15 | | | |
| Polymer | if added, included in formulation (to 100) | | | |
| NaOH | to adjust pH to 11 | | | |
| Water | up to 100 | | | |

TABLE 1a

Full Compositions with varying Detergent Active level and NaCl as Electrolyte

| Composition | Polymer Type | Polymer Molweight | Polymer % | Product Stability* | Product Viscosity (mPaS)** |
|---|---|---|---|---|---|
| A | — | — | 0 | Stable | 1060 |
| A | PEG | 2,000 | 1.6 | Stable | 510 |
| A | " | " | 2.5 | Stable | 110 |
| A | " | " | 3.9 | Unstable | 120 |
| B | — | — | 0 | Stable | 2480–2390 |
| B | PEG | 2,000 | 1.4 | Stable | 1730 |
| B | " | " | 2.2 | Stable | 460 |
| B | " | " | 2.9 | Stable | 190 |
| B | " | " | 3.6 | Stable | — |
| C | — | — | 0 | Stable | Paste (>3000) |
| C | PEG | 2,000 | 1.3 | Stable | 2510 |
| C | " | " | 2.7 | Stable | 860 |
| C | " | " | 3.4 | Unstable | — |
| D | — | — | 0 | Stable | 1940–2170 |
| D | PEG | 2,000 | 0.7 | Stable | 1070 |
| D | " | " | 1.5 | Stable | 280 |
| D | " | " | 2.2 | Unstable | — |
| E | — | — | 0 | Stable | 1900–2500 |
| E | PEG | 2,000 | 2.8 | Stable | 1080 |
| E | " | " | 3.5 | Stable | 660 |
| E | " | " | 4.2 | Stable | 340 |
| E | " | " | 4.9 | Unstable | — |

*Unless otherwise stated, stable means no more phase separation than 2% after two months storage at room temperature.

**Unless otherwise stated, the viscosity is measured at a shear rate of 21 $S^{-1}$.

TABLE 1b

Full Compositions with Approx 22% Detergent Active and NaCl as Electrolyte

| Composition | Polymer Type | Polymer Molweight | Polymer % | Product Stability | Product Viscosity (mPaS) |
|---|---|---|---|---|---|
| F | — | — | 0 | Stable | 1850 |
| F | PEG | 10,000 | 0.2 | Stable | 960 |
| F | " | " | 0.5 | Stable | 660 |
| F | " | " | 0.7 | Unstable | 700 |
| D | — | — | 0 | Stable | 1940–2170 |
| D | PEG | 10,000 | 0.2 | Stable | 790 |
| D | " | " | 0.4 | Stable | 610 |
| D | " | " | 0.5 | Stable | 640 |
| D | " | " | 0.7 | Unstable | 680 |
| E | — | — | 0 | Stable | 1900–2500 |
| E | PEG | 10,000 | 0.3 | Stable | 750 |
| E | " | " | 0.5 | Stable | 640 |
| E | " | " | 0.7 | Unstable | 710 |
| G | — | — | 0 | Stable | 2090 |
| G | PEG | 10,000 | 0.2 | Stable | 850 |
| G | " | " | 0.3 | Stable | 810 |
| G | " | " | 0.5 | Stable | 770 |
| G | " | " | 0.7 | Unstable | — |
| H | — | — | 0 | Stable | 2000 |
| H | PEG | 10,000 | 0.2 | Stable | 540 |
| H | " | " | 0.3 | Stable | 380 |
| H | " | " | 0.5 | Unstable | 360 |
| K | — | — | 0 | Stable | 1170 |
| K | PEG | 10,000 | 0.2 | Stable | 700 |
| K | " | " | 0.3 | Unstable | — |

TABLE 1c

Full Compositions with Approx 17% Detergent Active and NaCl as Electrolyte (Ethoxylated nonionic present : 3EO or 11EO)

| Composition | Polymer Type | Polymer Molweight | Polymer % | Product Stability | Product Viscosity (mPaS) |
|---|---|---|---|---|---|
| L | — | — | 0 | Stable | 2100 |
| L | PEG | 2,000 | 1.6 | Stable | 190 |
| L | " | " | 2.4 | Unstable | — |
| M | — | — | 0 | Stable | 1050 |
| M | PEG | 2,000 | 1.5 | Stable | 830 |
| M | " | " | 3.0 | Stable | 730 |
| M | " | " | 3.7 | Stable | 750 |
| M | " | " | 5.9 | Stable | 230 |
| M | " | " | 7.3 | Unstable | — |

TABLE 2

Full Compositions with Approx 23% Detergent Active and 10% Citrate as Electrolyte

| Composition | Polymer Type | Polymer Molweight | Polymer % | Product Stability | Product Viscosity (mPaS) |
|---|---|---|---|---|---|
| N | — | — | 0 | Stable | 1340 |
| N | PEG | 2,000 | 1.34 | Stable | 550 |
| N | " | " | 2.60 | Stable | 220 |
| N | " | " | 3.35 | Unstable | 200 |
| N | " | 10,000 | 0.34 | Stable | 1250 |
| N | " | " | 1.34 | Stable | 960 |
| N | " | " | 2.68 | Stable | 370 |
| N | " | " | 3.35 | Unstable | — |
| P | — | — | 0 | Stable | 1390–1320 |
| P | PEG | 2,000 | 1.34 | Stable | 650 |
| P | " | " | 2.01 | Stable | 490 |
| P | " | " | 2.68 | Unstable | — |
| P | " | 10,000 | 1.34 | Stable | 1190 |
| P | " | " | 2.68 | Stable | 1060 |
| P | PEG | 10,000 | 4.02 | Stable | 970 |
| P | " | " | 5.36 | Stable | 760 |
| P | " | " | 6.70 | Unstable | 350 |
| R | — | — | 0 | Stable | 1380 |
| R | PEG | 2,000 | 0.67 | Stable | 930 |
| R | " | " | 1.34 | Stable | 430 |
| R | " | " | 2.68 | Unstable | — |
| R | " | 10,000 | 1.34 | Stable | 1230 |
| R | " | " | 2.68 | Stable | 860 |
| R | " | " | 4.02 | Stable | 770 |
| R | " | " | 5.36 | Stable | 810 |
| R | " | " | 6.70 | Unstable | 480 |
| S | — | — | 0 | Stable | 1120 |
| S | PEG | 10,000 | 1.34 | Stable | 1130 |
| S | " | " | 2.68 | Stable | 730 |
| S | " | " | 3.35 | Unstable | 620 |
| T | — | — | 0 | Stable | 1500 |
| T | PEG | 10,000 | 1.34 | Stable | 1300 |
| T | " | " | 2.68 | Stable | 630 |
| T | " | " | 4.02 | Unstable | — |

TABLE 3

Full Compositions with Approx 23% Detergent Active and 15% Citrate as Electrolyte

| Composition | Polymer Type | Polymer Molweight | Polymer % | Product Stability | Product Viscosity (mPaS) |
|---|---|---|---|---|---|
| V | — | — | 0 | Stable | 1530 |
| V | PEG | 2,000 | 0.31 | Stable | 210 |
| V | PEG | 2,000 | 0.62 | Unstable | — |
| X | — | — | 0 | Stable | 1500 |
| X | PEG | 2,000 | 0.62 | Stable | 570 |
| X | PEG | 2,000 | 1.25 | Unstable | — |

TABLE 4

Full Compositions with Approx 24% Detergent Active, NaCl as Electrolyte and varying polymer types

| | Polymer | | | Product | |
|---|---|---|---|---|---|
| Composition | Type | Molweight | % | Stability | Viscosity (mPaS) |
| B | — | — | 0 | Stable | 2390–2480 |
| B | Dextran | 4,000–6,000 | 1.4 | Stable | 1600 |
| B | Dextran | 4,000–6,000 | 2.9 | Stable | 600 |
| B | Dextran | 4,000–6,000 | 3.6 | Unstable | — |
| B | Dextran | 8,000–12,000 | 0.7 | Stable | 1530 |
| B | Dextran | 8,000–12,000 | 1.4 | Stable | 910 |
| B | Dextran | 8,000–12,000 | 2.2 | Stable | 570 |
| B | Dextran | 8,000–12,000 | 3.6 | Unstable | — |
| B | Dextran | 15,000–20,000 | 0.7 | Stable | 880 |
| B | Dextran | 15,000–20,000 | 1.4 | Unstable | — |
| B | Dextran Sulphonate | 15,000–20,000 | 0.7 | Stable | 990 |
| B | Dextran Sulphonate | 15,000–20,000 | 1.4 | Unstable | — |
| B | Polyacrylate | 2,000 | 1.4 | Stable | 1230 |
| B | Polyacrylate | 2,000 | 2.2 | Stable | 640 |
| B | Polyacrylate | 2,000 | 2.9 | Unstable | — |
| B | Polyacrylate | 5,000 | 0.7 | Stable | 1230 |
| B | Polyacrylate | 5,000 | 1.4 | Stable | 750 |
| B | Polyacrylate | 5,000 | 2.2 | Unstable | — |

TABLE 5

Full Compositions with Approx 23% Detergent Active, Na-citrate as Electrolyte and varying polymer types

| | Polymer | | | Product | |
|---|---|---|---|---|---|
| Composition | Type | Molweight | % | Stability | Viscosity (mPaS) |
| P | — | — | 0 | Stable | 1320–1390 |
| P | Dextran | 4,000–6,000 | 0.3 | Stable | 820 |
| P | Dextran | 4,000–6,000 | 0.7 | Stable | 350 |
| P | Dextran | 4,000–6,000 | 1.3 | Unstable | — |
| P | Dextran | 8,000–12,000 | 0.17 | Stable | 920 |
| P | Dextran | 8,000–12,000 | 0.3 | Stable | 540 |
| P | Dextran | 8,000–12,000 | 0.7 | Stable | 250 |
| P | Dextran | 8,000–12,000 | 1.3 | Unstable | — |
| P | Dextran | 15,000–20,000 | 0.17 | Stable | 660 |
| P | Dextran | 15,000–20,000 | 0.3 | Stable | 390 |
| P | Dextran | 15,000–20,000 | 0.7 | Unstable | — |
| P | Dextran Sulphonate | 15,000–20,000 | 0.17 | Stable | 880 |
| P | Dextran Sulphonate | 15,000–20,000 | 0.3 | Stable | 620 |
| P | Dextran Sulphonate | 15,000–20,000 | 0.7 | Stable | 390 |
| P | Dextran Sulphonate | 15,000–20,000 | 1.3 | Unstable | — |
| P | Dextran | 200,000–275,000 | 0.17 | Stable | 790 |
| P | Dextran | 200,000–275,000 | 0.3 | Stable | 620 |
| P | Dextran | 200,000–275,000 | 0.7 | Unstable | — |
| P | Polyacrylate | 2,000 | 0.22 | Stable | 940 |
| P | Polyacrylate | 2,000 | 0.4 | Stable | 400 |
| P | Polyacrylate | 2,000 | 0.9 | Unstable | — |
| P | Polyacrylate | 5,000 | 0.07 | Stable | 880 |
| P | Polyacrylate | 5,000 | 0.13 | Stable | 590 |
| P | Polyacrylate | 5,000 | 0.27 | Stable | 370 |
| P | Polyacrylate | 5,000 | 0.54 | Unstable | — |
| P | Polyacrylate | 1,200 | 0.15 | Stable | 1090 |
| P | Polyacrylate | 1,200 | 0.3 | Stable | 870 |
| P | Polyacrylate | 1,200 | 0.6 | Stable | 320 |
| P | Polyacrylate | 1,200 | 0.9 | Unstable | — |
| P | Sokalan CP5 | 70,000 | 0.17 | Stable | 820 |
| P | Sokalan CP5 | 70,000 | 0.3 | Stable | 680 |
| P | Sokalan CP5 | 70,000 | 0.7 | Stable | 470 |
| P | Sokalan CP5 | 70,000 | 1.3 | Unstable | — |
| P | DKW 125 | 7,500 | 0.08 | Stable | 970 |
| P | DKW 125 | 7,500 | 0.15 | Stable | 630 |
| P | DKW 125 | 7,500 | 0.30 | Stable | 260 |
| P | DKW 125 | 7,500 | 0.60 | Unstable | — |
| P | QR 1010 | 4,000 | 0.08 | Stable | 1150 |
| P | QR 1010 | 4,000 | 0.17 | Stable | 980 |
| P | QR 1010 | 4,000 | 0.3 | Stable | 680 |
| P | QR 1010 | 4,000 | 0.7 | Stable | 280 |
| P | QR 1010 | 4,000 | 1.0 | Unstable | — |

TABLE 6

Full Compositions with Citrate and with Minors

| Composition | Polymer Type | Polymer Molweight | Polymer % | Product Stability | Product Viscosity (mPaS) |
|---|---|---|---|---|---|
| AA | — | — | 0 | Stable | 1730 |
| AA | PEG | 6,000 | 1 | Stable | 1090 |
| AA | PEG | 6,000 | 2 | Stable | 820 |
| AA | PEG | 6,000 | 3 | Unstable | 230 |
| BB | — | — | 0 | Stable | 1280 |
| BB | PEG | 6,000 | 1 | Stable | 800 |
| BB | PEG | 6,000 | 2 | Stable | 640 |
| BB | PEG | 6,000 | 3 | Unstable | 180 |
| CC | — | — | 0 | Stable | 1280 |
| CC | Polyacrylate | 2,000 | 0.5 | Stable | 820 |
| CC | Polyacrylate | 2,000 | 0.75 | Stable | 370 |
| CC | Polyacrylate | 2,000 | 1.0 | Unstable | 290 |
| DD | — | — | 0 | Stable | 1730 |
| DD | Polyacrylate | 2,000 | 0.5 | Stable | 360 |
| DD | Polyacrylate | 2,000 | 0.75 | Stable | 290 |

TABLE 6-continued

Full Compositions with Citrate and with Minors

| Composition | Polymer Type | Polymer Molweight | Polymer % | Product Stability | Product Viscosity (mPaS) |
|---|---|---|---|---|---|
| DD | Polyacrylate | 2,000 | 1.0 | Unstable | 360 |

TABLE 7

Sodium Tripolyphosphate or Sodium Citrate and/or Carbonate as Electrolyte

| | EE | FF | GG | HH |
|---|---|---|---|---|
| Petrelab 550 | 14 | 16 | 12 | 14 |
| Potassium Coconut soap | — | — | 2 | 2 |
| Synperonic A7 | 6 | 4 | 6 | 4 |
| STP | 2 | 2 | 2 | 2 |
| Sodium Carbonate | 4 | 4 | 4 | 4 |
| Perfume | 1 | 1 | 1 | 1 |
| Water | to 100% | to 100% | to 100% | to 100% |
| Viscosity (mPaS at 21 $sec^{-1}$): | | | | |
| – no polymer | 925 | 990 | 970 | 870 |
| + PEG 2000 | 230 | 405 | 650 | 570 |
| Polymer concentration | 4% | 2% | 1% | 1% |
| Polymer concentration giving unstable product | >5% | >3% | >2% | >2% |

| | II | JJ | KK | LL | MM | NN | OO |
|---|---|---|---|---|---|---|---|
| DOBS 102 | 14.3 | 14.3 | 14.3 | 14.3 | 14.3 | 14.3 | 14.3 |
| Potassium coconut soap | 2.2 | 2.2 | 2.2 | 2.2 | 2.2 | 2.2 | 2.2 |
| Dobanol 91-6 | 5.5 | 5.5 | 5.5 | 5.5 | 5.5 | 5.5 | 5.5 |
| STP | 6 | 8 | 2 | — | — | — | — |
| Trisodium Citrate | — | — | — | — | 7 | 5 | 2 |
| Sodium Carbonate | 2 | — | 5 | 5 | — | 2 | 4 |
| Perfume | 0.3 | 0.3 | 0.3 | 0.3 | 0.3 | 0.3 | 0.3 |
| Water | to 100% | to 100% | to 100% | to 100% | to 100% | to 100% | to 100% |
| Viscosity/No polymer | 960 | 1570 | 1210 | 1480 | 1440 | 1230 | 1450 |
| + PEG 2000 | | | | | | | |
| Viscosity | 470 | 510 | 440 | 580 | 500 | 460 | 570 |
| Concentration | 1.0% | 0.5% | 1.5% | 1.0% | 1.0% | 1.0% | 1.0% |
| Concentration for instability | ≧1.5% | ≧1.0% | ≧2.0% | ≧1.5% | ≧1.5% | ≧1.5% | ≧1.5% |
| + PEG 10000 (0.5%) | | | | | | | |
| Viscosity | 800 | 770 | 1080 | 820 | 940 | 890 | 1050 |
| Concentration for instability | ≧1.0% | ≧1.0% | ≧1.0% | ≧1.0% | ≧1.0% | ≧1.0% | ≧1.0% |
| + Dextran C (0.5%) | | | | | | | |
| Viscosity | Unstable | Unstable | 540 | Unstable | 480 | 405 | 550 |
| Concentration for instability | ≧0.5% | ≧0.5% | ≧1.0% | ≧0.5% | ≧1.0% | ≧1.0% | ≧1.0% |
| + Dextran T | | | | | | | |
| Viscosity | — | — | 330 | — | 410 | 370 | 400 |
| Concentration | — | — | 1% | — | 1.0% | 1.0% | 0.5% |
| Concentration for instability | ≧0.5% | ≧0.5% | ≧1.5% | ≧0.5% | ≧1.5% | ≧1.5% | ≧1.0% |

DOBS 102 = Linear alkyl benzene sulphonate, ex. Shell
Petrelab 550 = linear alkyl benzene sulphonate, ex. Petresa
Coconut fatty acid = ex. Unichema
Synperonic A7 = $C_{13}/C_{15}$ alcohol ethoxylate (7EO) ex. ICI
Dobanol 91-6 = $C_9/C_{11}$ alcohol ethoxylate (6EO), ex. Shell
PEG 2000 = Polyethylene glycol, molecular weight 200 ex. BDH
PEG 10000 = Polyethylene glycol M.W. 10000. ex. BDH
Dextran C = Dextran, M.W. 75000, ex. BDH
Dextran T = Dextran, M.W. 10000, Ex. Pharmacia (Sweden)

We claim:

1. An aqueous surfactant structured liquid detergent concentrate comprising from 0–10% by volume suspended solid material and further comprising:

(a) at least 15% by weight of detergent active material, said material comprising:

(A) a nonionic surfactant or a polyalkoxylated anionic surfactant or mixture thereof; and (B) a non-polyalkoxylated anionic surfactant;

wherein the weight ratio of component (A) to component (B) is from 2.8:1 to 1:4;

(b) from 1 to 30% of a salting out electrolyte;

(c) from 0.1 to 20% by weight of a viscosity reducing water soluble polymer, selected from the group consisting of Dextran, Dexran sulphonate, polyacrylate and polyacrylate/maleic acid copolymers, said polymer being present in an amount sufficient to reduce the viscosity by more than 5% when measured at a shear rate of 21 $S^{-1}$ and in comparison with a composition identical except that all such polymer is omitted, said polymer having an electrolyte resistance (as hereinbefore defined) of more than 5 grams sodium nitrilotriacetate in 100 of a 5% by weight aqueous solution thereof, with the system adjusted to neutral pH, and said polymer having a vapour pressure in 20% aqueous solution equal to or less than the vapour pressure of a reference 2% by weight or greater aqueous solution of a polyethylene glycol having an average molecular weight of 6000;

said viscosity reducing polymer having a molecular weight of at least 1,000;

and the composition comprising no, or less than 5% by weight of a swelling clay and yielding no more than 2% phase separation upon storage at 25° C. for 21 days and having a viscosity of no greater than 1000 mPaS at a shear rate of 21 $s^{-1}$.

2. A composition according to claim 1, wherein the electrolyte resistance of the polymer is more than 10 grams sodium nitrilotriacetate.

3. A composition according to claim 2, wherein said electrolyte resistance of the polymer is more than 15 grams sodium nitrilotriacetate.

4. A composition according to claim 1, wherein the concentration of the reference solution is 10% by weight.

5. A composition according to claim 4, wherein the concentration of the reference solution is 18% by weight.

6. A concentrate according to claim 1, wherein the amount of the polymer is from 0.1 to 2.5% by weight.

7. A concentrate according to claim 6, wherein the amount of the polymer is from 0.5 to 1.5% by weight.

8. A concentrate according to claim 1, wherein the average molecular weight of the polymer is at least 2000.

9. A concentrate according to claim 8, wherein the average molecular weight of the polymer is at least 5000.

10. A concentrate according to claim 1, wherein the suspended solid material comprises a substantially water-insoluble bleach.

11. A concentrate according to claim 10, wherein the bleach comprises DPDA.

12. A concentrate according to claim 1, wherein the detergent active material is at least 20% by weight of the total composition.

13. A concentrate according to claim 12, wherein the detergent active material is at least 25% by weight of the total composition.

14. A concentrate according to claim 1, having a viscosity of no greater than 850 mPaS at a shear rate of 21 $s^{-1}$.

* * * * *